US005396853A

United States Patent [19]

Huang

[11] Patent Number: 5,396,853

[45] Date of Patent: Mar. 14, 1995

[54] DOUBLE-THREAD HAND SEWING MACHINE TRANSMISSION MECHANISM

[76] Inventor: Dennis Huang, 2F, No. 1, Len 9, Ningpo E. Street, Taipei, Taiwan, Prov. of China

[21] Appl. No.: 206,099

[22] Filed: Mar. 4, 1994

[51] Int. Cl.[6] ..... D05B 97/02

[52] U.S. Cl. ..... 112/169

[58] Field of Search ..... 112/169, 185, 189, 191, 112/199, 80, 221, 192, 193

[56] References Cited

U.S. PATENT DOCUMENTS

| | | | |
|---|---|---|---|
| 2,594,534 | 4/1952 | Bell | 112/169 |
| 3,745,950 | 7/1973 | Kato | 112/169 |
| 3,957,004 | 5/1976 | Ketterer | 112/169 |
| 4,501,211 | 2/1985 | Seyama | 112/169 |

*Primary Examiner*—Peter Nerbun
*Attorney, Agent, or Firm*—Bucknam & Archer

[57] ABSTRACT

A double-thread hand sewing machine transmission mechanism including a steering gear driven by a motor, a driven wheel, a transmission gear driven by the steering gear to turn the driven wheel, an upper-thread arm reciprocated by the driven wheel to move a needle up and down in making stitches, the improvement includes an under-thread bobbin, an under-thread bar having a locating ring at one end mounted around an eccentric locating ring on the transmission gear at one side and a rack at an opposite end meshed with a toothed portion on the under-thread bobbin and driven to turn the under-thread bobbin back and forth.

1 Claim, 2 Drawing Sheets

DOUBLE-THREAD HAND SEWING MACHINE TRANSMISSION MECHANISM

BACKGROUND OF THE INVENTION

The present invention relates to hand sewing machines, and relates more particularly to a transmission mechanism for a double-thread hand sewing machine.

Various motor-driven hand sewing machines have been disclosed, and have appeared on the market. These hand sewing machines are commonly of single-thread type, i.e., only one thread is moved by the needle to make stitches on the fabric. Because only one thread is drawn to make stitches on the fabric, the last loop of the stitches must be tied into a knot. However, if the knot or either thread section of the stitches is broken or the knot is loosed, the stitches will be easily removed from the fabric. Therefore, a single-thread hand sewing machine is not suitable for sewing permanent stitches on fabrics.

SUMMARY OF THE INVENTION

The present invention has been accomplished to provide a transmission mechanism for a double-thread hand sewing machine which eliminates the aforesaid problems. An under-thread bar is provided having a rear end terminating in a mounting ring mounted on an eccentric locating ring on the transmission gear at one side and a front end terminating in a rack meshed with a toothed portion on an under-thread bobbin. Therefore, when the upper-thread arm is reciprocated vertically by the transmission gear via a driven wheel, the under-thread bar is reciprocated horizontally to turn the under-thread bobbin back and forth permitting the under-thread to be fastened with the upper thread in making stitches on the fabric.

DETAILED DESCRIPTION OF THE PREFERRED EMBODIMENT

Figure 1:
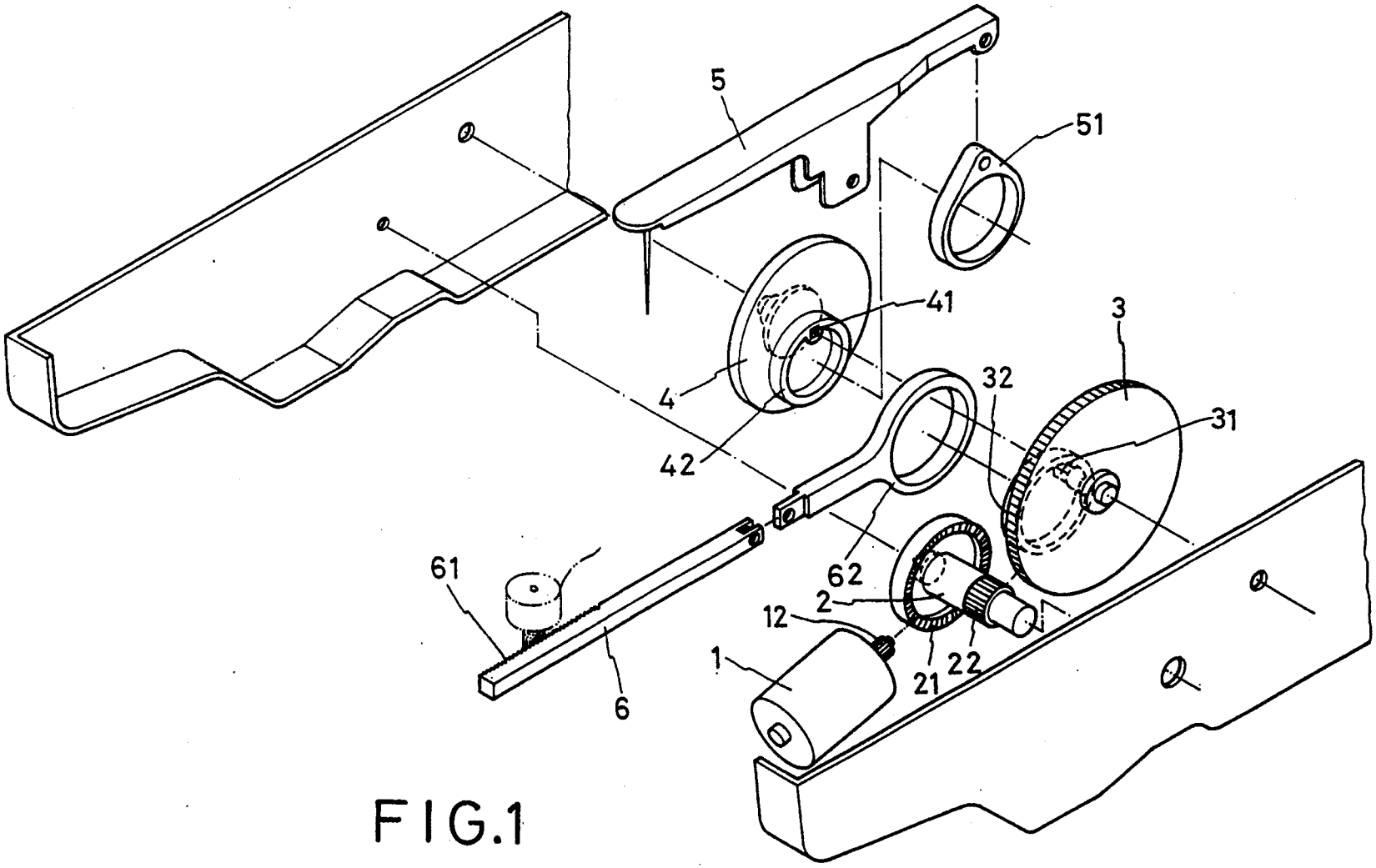
FIG. 1 is an exploded view of a double-thread hand sewing machine transmission mechanism according to the preferred embodiment of the present invention.
Figure 2:
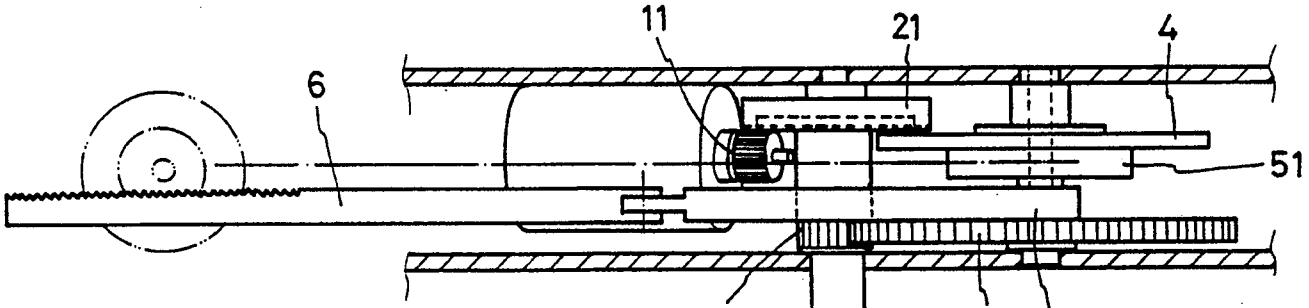
FIG. 2 is a longitudinal view in section of the transmission mechanism shown in FIG. 1.
Figure 3:
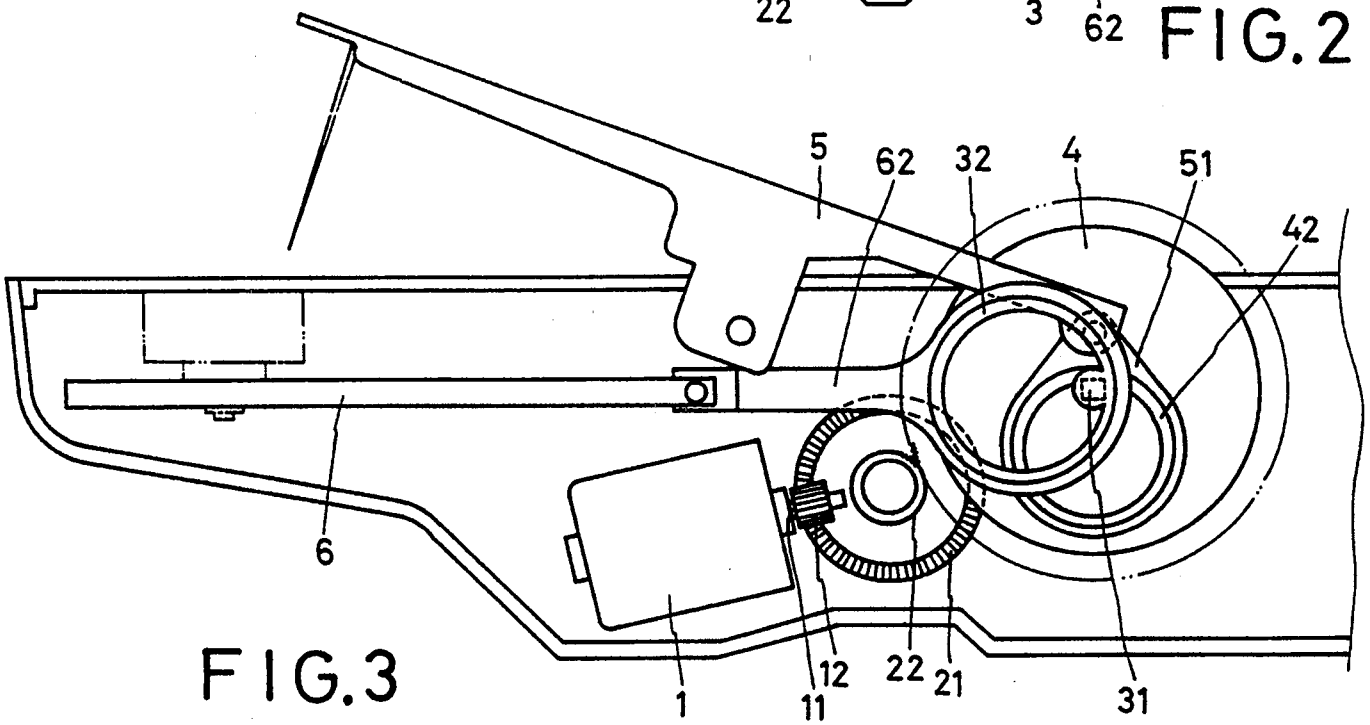
FIG. 3 is a side assembly view of the transmission mechanism shown in FIG. 1.

Referring to FIGS. 1, 2, and 3, a double-thread hand sewing machine in accordance with the present invention is generally comprised of a motor 1, a steering gear 2, a transmission gear 3, a driven wheel 4, an upper-thread arm 5, and a under-thread bar 6.

The motor 1 has a pinion 12 on the output shaft 11 thereof. The steering gear 2 comprises a crown gear 21 meshed with the pinion 12 on the output shaft 11 of the motor 1, and an output gear 22 mounted on the gear shaft of the crown gear 21 and meshed with the transmission gear 3. The number of teeth of the crown gear 21 is more than that of the pinion 12 and the output gear 22 for speed reduction. The transmission gear 3 has a square gear shaft 31 fastened to the driven wheel 4, and an eccentric locating ring 32 at one side coupled to the under-thread bar 6. The number of teeth of the transmission gear 3 is more than that of the output gear 22 for speed reduction. The driven wheel 4 has a square center hole 41, which receives the square gear shaft 31 of the transmission gear 3, and an eccentric locating ring 42 at one side coupled to the upper-thread arm 5. The upper-thread arm 5 has a needle at the front end, and a mounting ring 51 at the rear end mounted around the locating ring 42 on the driven wheel 4. When the driven wheel 4 is turned, the upper-thread arm 5 is moved up and down by the locating ring 42 on the driven wheel 4. The under-thread bar 6 has a rack 61 at the front end meshed with the under-thread bobbin, and a mounting ring 62 at the rear end mounted around the locating ring 32 of the transmission gear 3. When the transmission gear 3 is turned, the under-thread bar 6 is reciprocated horizontally causing the under-thread bobbin to turn back and forth.

Referring to FIGS. 2 and 3 again, when the motor 1 is started to turn steering gear 2 through the pinion 12, the transmission gear 3 is turned by the output gear 22 of the steering gear 2 to reciprocate the under-thread bobbin via the under-thread bar 6, and at the same time the driven wheel 4 is turned by the square gear shaft 31 of the transmission gear to move the upper-thread arm 5 up and down causing the needle of the upper-thread arm 5 to make stitches with the under-thread bobbin 71.

While only one embodiment of the present invention has been shown and described, it will be understood that various modifications and changes could be made without departing from the spirit and scope of the invention.

What is claimed is:

1. A double-thread hand sewing machine transmission mechanism comprising: a motor having a pinion on an output shaft thereof; a steering gear having a crown gear meshed with said pinion and an output gear mounted on the gear shaft of said crown gear; a transmission gear meshed with said output gear of said steering gear; a driven wheel coupled to said transmission gear at one side; an upper-thread arm having a rear end linked to an eccentric ring at one side of said driven wheel and a front end fastened with a needle for carrying an upper thread in making stitches; the improvement comprising an eccentric locating ring on said transmission gear at one end, an under-thread bar having a rear end coupled with a mounting ring mounted on the eccentric locating ring of said transmission gear and a front end terminating in a rack, and an under-thread bobbin having a toothed portion meshed with the rack of said under-thread bar, said under-thread bobbin being turned back and forth by the rack of said under-thread bar as said transmission gear is driven by said motor through said steering gear to reciprocate said upper-thread arm vertically in moving the needle of said upper-thread arm to make stitches.

* * * * *